US006817194B1

(12) United States Patent
Leach

(10) Patent No.: US 6,817,194 B1
(45) Date of Patent: Nov. 16, 2004

(54) PUMPS

(75) Inventor: Bernard Leach, Battle (GB)

(73) Assignee: Aspen Pumps Limited, East Susses (GB)

( * ) Notice: Subject to any disclaimer, the term of this patent is extended or adjusted under 35 U.S.C. 154(b) by 0 days.

(21) Appl. No.: 10/453,871

(22) Filed: Jun. 4, 2003

(51) Int. Cl.[7] ..... F25D 21/00; F25D 21/14
(52) U.S. Cl. ..... 62/150; 62/285
(58) Field of Search ..... 62/150, 285, 272, 62/288, 289, 259.1, 291, 431; 417/40, 360, 424.14, 279, 410.1, 413.3

(56) References Cited

U.S. PATENT DOCUMENTS 3,758,236 A * 9/1973 Zimmerman ..... 417/360
6,203,281 B1 * 3/2001 Gurega ..... 417/40
6,322,326 B1 * 11/2001 Davis et al. ..... 417/40

* cited by examiner

*Primary Examiner*—Chen Wen Jiang
(74) *Attorney, Agent, or Firm*—Dowell & Dowell, P.C.

(57) ABSTRACT

A conduit elbow having first opening and a second opening and housing a pump assembly for use in an air conditioning system, the pump assembly including a pump having a pump inlet and a pump outlet, and wherein the pump inlet is a fluid communication with a reservoir. The reservoir is formed integrally with the pump assembly and has an inlet fluid communication with a first fluid-carrying pipe of an air-conditioning installation and wherein the pump outlet of an air fluid communication with a second fluid-carrying pipe of an air-conditioning installation.

12 Claims, 3 Drawing Sheets

PUMPS

BACKGROUND OF THE INVENTION

1. Field of the Invention

The present invention relates to improvements in or relating to pumps, in particular to pumps in air conditioning installations.

2. Brief Description of the Related Art

In air-conditioning installations within buildings, atmospheric moisture is extracted from the air by condensation. The condensate needs to be disposed of and typically this is arranged by pumping the condensate away from an evaporator unit, usually installed externally of the building, to a drain. Typically the pipework for the air-conditioning is carried by channels suspended from ceilings or in ducting or conduits for protection. Pumps involved in air-conditioning installations are often bulky and obtrusive as they need to be located in a position convenience for servicing. The present invention seeks to address this problem.

SUMMARY OF THE INVENTION

According to the present invention there is provided, in one aspect, a pump assembly for use in an air conditioning system, the pump assembly comprising a pump having a pump inlet and a pump outlet, and wherein the pump inlet is in fluid communication with a reservoir, said reservoir being formed integrally with the pump assembly and said reservoir having a reservoir inlet in fluid communication with a first fluid-carrying pipe of an air-conditioning installation; wherein the pump outlet is in fluid communication with a second fluid-carrying pipe of an air-conditioning installation.

Preferably, the pump assembly includes a float switch arrangement and adapted to cause actuation of the pump when a level of fluid within the reservoir exceeds a first predetermined level. More preferably, the float switch is adapted to cause actuation of an alarm when the level of fluid within the reservoir exceeds a second predetermined level, said second predetermined level being greater than the first predetermined level.

Preferably, the float switch arrangement comprises a sensor housing projecting into the reservoir, housing at least one sensor, suitably of the Hall effect semiconductor type, at a position defining said first predetermined level and a magnetic float free to move axially about the sensor housing.

In a second aspect, there is provided a conduit elbow having a first opening and a second opening and integrally housing a pump assembly as defined above.

Preferably, the elbow further includes at least one channel for receipt, in use, of cables and/or further pipework.

A BRIEF DESCRIPTION OF THE DRAWINGS

The above and other aspects of the present invention will now be described in further detail, by way of example only, with reference to the accompanying drawings, in which.

DESCRIPTION OF THE PREFERRED EMBODIMENT

Figure 1:
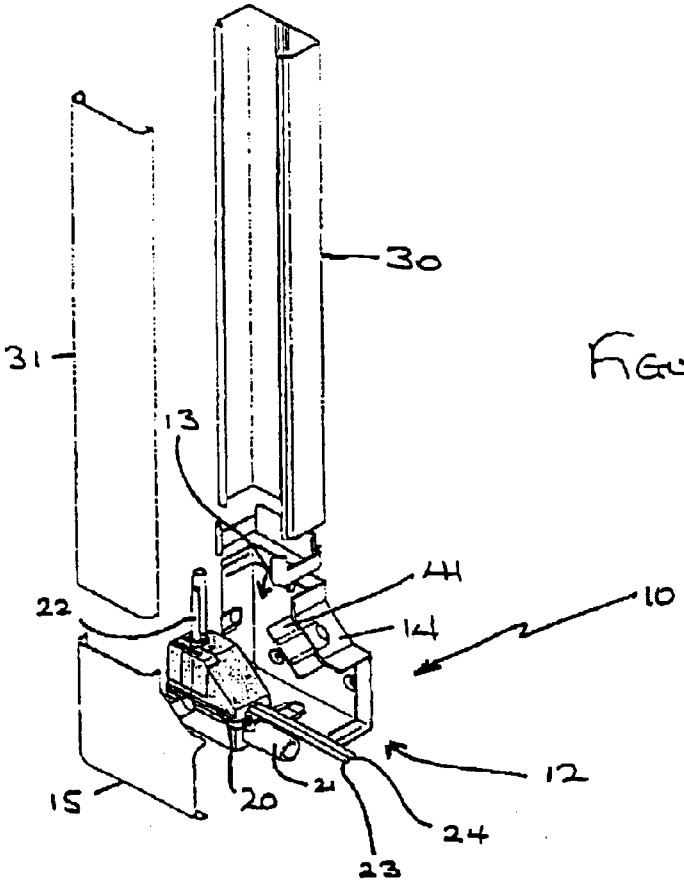
FIG. 1 is an exploded perspective view of an embodiment of an elbow in accordance with the present invention in combination with conditioning conduit.

Referring to the Figures, there is illustrated an embodiment of an elbow 10 in accordance with the second aspect of the present invention. The elbow comprises a housing 11 having a first opening 12 and a second opening 13 defined between a base element 14 and a cover 15. Mounted within the channel element 14 is a pump assembly 20 having an inlet 21 and an outlet 22 orientated at 90° to the inlet 21. Pump assembly 20 incorporates an electrically operated pump and is supplied by means of an electrical power supply 23. In the preferred embodiments, the pump 20 also includes an alarm switch (not shown) which, by means of a cable 24, actuates an alarm and may be also switch off the air-conditioning unit in the event of pump failure.

In a typical air-conditioning installation, elbow 10 is used in combination with additional conventional elongate conduit channel 30 and cover 31 elements connected at each opening 12,13. In the embodiment shown, the elbow is designed with a rectangular section to match the rectangular section of the conduit with which the elbow is being used. It will be appreciated that many designs of conduit with widely varying dimensions are available. The design of the elbow housing 11 will be adapted accordingly to match.

Figure 2:
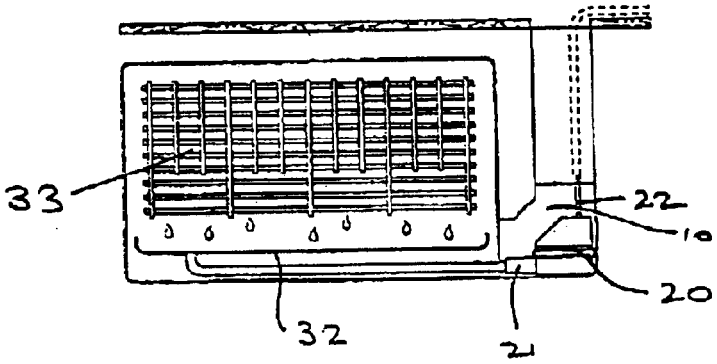
FIG. 2 is a schematic side view of the conduit of FIG. 1 in a typical air-conditioning installation.
Figure 3:
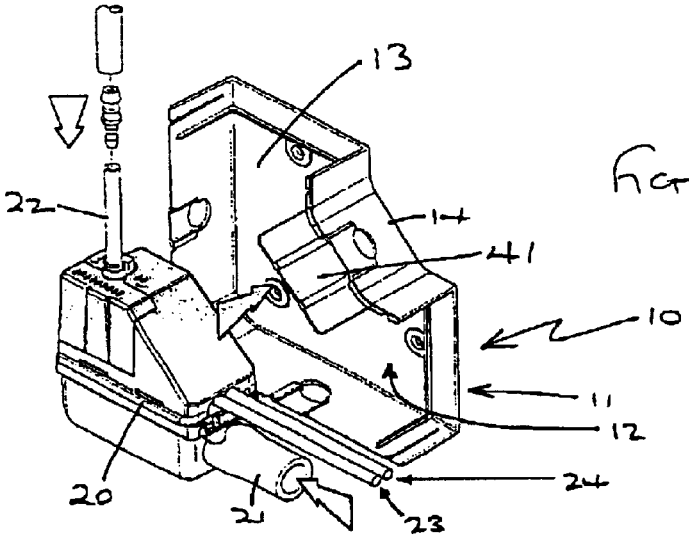
FIG. 3 is a detailed exploded view of the elbow of FIG. 1.
Figure 4:
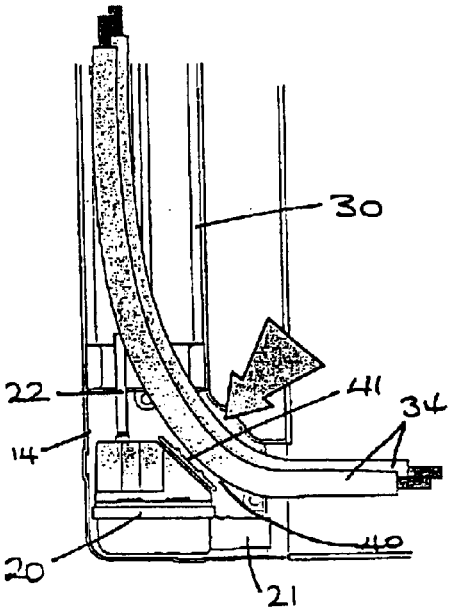
FIG. 4 is a detailed side view of the elbow of FIG. 1.
Figure 5:
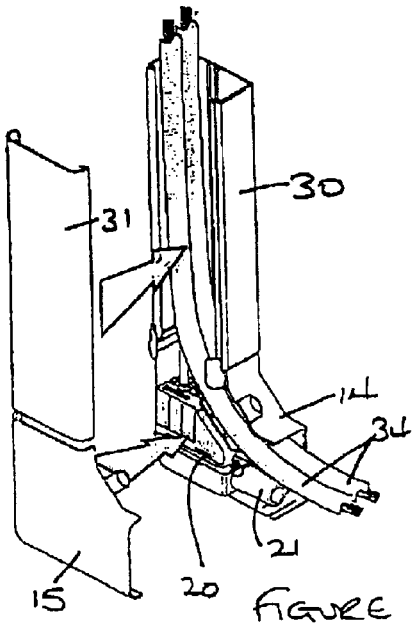
FIG. 5 is an exploded view illustrating the elbow of FIG. 1 in combination with other components of a typical air-conditioning installation.

FIG. 2 illustrates the elbow 10 of FIG. 1 in a typical installation in which the inlet 21 of the pump assembly 20 is in operative connection with the tray 32 of an evaporator unit 33.

In a preferred embodiment, the elbow housing 11 further includes a channel to allow for the routing of additional cables, breather tubes and additional pipework 34. In the embodiment illustrated, channel 40 is formed by provision of a dividing wall 41 projecting from the rear wall of the base element 14, dividing a channel 40 from an area of the base element housing the pump assembly 20.

Figure 6:
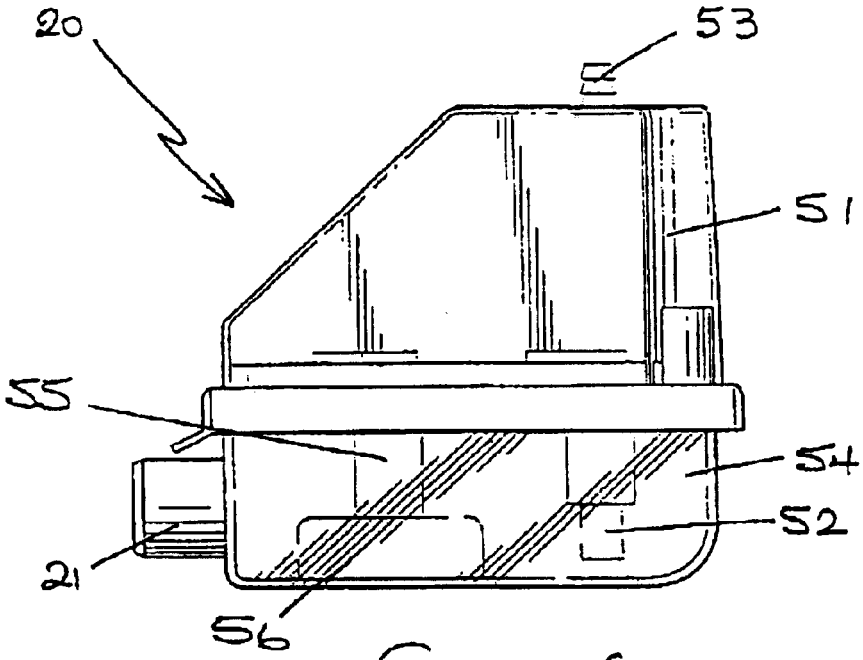
FIG. 6 is a side view of an embodiment of a pump assembly in accordance with the present invention.
Figure 7:
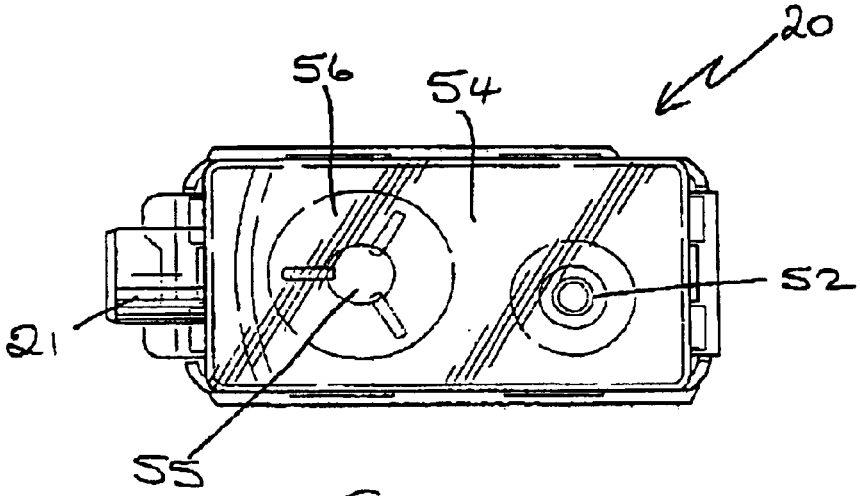
FIG. 7 is a bottom view of the pump assembly of FIG. 6.

The pump assembly 20 itself will now be described in further detail with particular reference to FIGS. 6 and 7. Pump assembly 20 includes a pump in a pump housing 51 and having a pump inlet 52 and a pump outlet 53. Pump inlet 52 is in fluid communication with a reservoir 54 formed integrally with the pump assembly 20. The reservoir has an inlet forming the pump assembly inlet 21.

In the preferred embodiment, the pump assembly 20 includes a float switch arrangement to cause actuation of the pump when the level of fluid within the reservoir reaches a certain level. Preferably, the float switch is adapted to trigger and alarm and/or prevent continued operation of the air conditioning system if the fluid level reaches a second, higher level, which may, for example, indicate a blockage in the system.

A typical float switch arrangement is illustrated in which a housing in the form of a sealed finger 55 depends from pump housing 51 into reservoir 54. Mounted within finger 55 are three axially spaced sensors (not shown) each responsive to a magnetic field induced by a magnetic float 56 around finger 55 and constrained to move axially with respect thereto. Typically, magnetic float 56 includes a disc-shaped magnet supported upon a foamed plastic float material, such as expanded polystyrene. Suitably, the sensors are of the Hall-effect semi-conductor type.

The lowermost sensor acts, as the fluid level in the reservoir falls, to turn off the pump. The intermediate sensor acts, as the fluid level begins to rise, to actuate the pump. The uppermost sensor acts when the fluid level reaches a height indicating that the capacity of the pump is being reached, perhaps indicating a blockage in the air-conditioning pipework. Typically, this sensor will trigger actuation of an alarm Suitably, the pump is capable of pumping about 14 liters of water per hour at zero head.

The pump assembly and conduit elbow of the present invention offer a number of advantages over existing arrangements. For example, the conduit enables the pump assembly to be mounted such that the reservoir is horizontal in both left handed and right handed orientations. A typical problem with existing arrangements arises when the pump is not active. Condensate in the pipework and the conventional reservoir in the evaporator, which tends to be some distance from the pump tends to siphon through the pump, which is usually at an elevated position, to the drain. This leads to difficulties priming the pump upon restarting and even if pumping can be restarted, it is associated with considerable noise as a large amount of air is drawn through the pump. The pump assembly of the present invention, by inclusion of an integral reservoir enables sufficient condensate to remain in the reservoir such that the pump inlet 52 remains covered, thereby avoiding difficulties and noise associated with priming of the pump. Additionally, a non-return valve can be incorporated between the pump inlet and pump outlet to prevent siphoning. Furthermore, the compact nature of the design of the pump assembly means that it can easily be accommodated within the elbow of air-conditioning conduit, whilst leaving sufficient room for other cabling and pipework.

What is claimed is:

1. In combination, a conduit elbow having a first opening and a second opening and housing a pump assembly comprising a pump having a pump inlet and a pump outlet, and wherein the pump inlet is in fluid communication with a reservoir, said reservoir being formed integrally with the pump assembly and said reservoir having a reservoir inlet in fluid communication with a first fluid-carrying pipe of an air-conditioning installation, wherein the pump outlet is in fluid communication with a second fluid-carrying pipe of an air-conditioning installation.

2. The combination conduit elbow and pump assembly as claimed in claim 1 wherein the pump assembly includes a float switch arrangement adapted to cause actuation of the pump when a level of fluid within the reservoir exceeds a first predetermined level.

3. The combination conduit elbow and pump assembly as claim in claim 2 wherein the float switch is adapted to cause actuation of an alarm when the level of fluid within the reservoir exceeds a second predetermined level, said second predetermined level being greater than the first predetermined level.

4. The combination conduit elbow and pump assembly as claimed in claim 3 wherein the float switch is adapted to stop operation of the pump when the level of fluid within the reservoir falls to a third predetermined level.

5. The combination conduit elbow and pump assembly as claimed in claim 4 wherein the float switch arrangement comprises a sensor housing projecting into the reservoir, housing at least one sensor, of the Hall effect semiconductor type, at a position defining each of said predetermined levels, and a magnetic float constrained to move axially about the sensor housing.

6. The combination conduit elbow and pump assembly as claimed in claim 3 wherein the float switch arrangement comprises a senor housing projecting into the reservoir, housing at least one senor, of the Hall effect semiconductor type, at a position defining each of said predetermined levels, and a magnetic float constrained to move axially about the sensor housing.

7. The combination conduit elbow and pump assembly as claimed in claim 2 wherein the float switch is adapted to stop operation of the pump when the level of fluid within the reservoir falls to a third predetermined level.

8. The combination conduit elbow and pump assembly as claimed in claim 7 wherein the float switch arrangement comprises a sensor housing projecting into the reservoir, housing at least one sensor, of the Hall effect semiconductor type, at a position defining each of said predetermined levels, and a magnetic float constrained to move axially about the sensor housing.

9. The combination conduit elbow and pump assembly as claimed in claim 2 wherein the float switch arrangement comprises a sensor housing projecting into the reservoir, housing at one sensor, of the Hall effect semiconductor type, at a position defining each of said predetermined levels, and a magnetic float constrained to move axially about the sensor housing.

10. The combination conduit elbow and pump assembly as claimed in claim 2 wherein the elbow further includes at least one channel for receipt of cables and/or further pipework.

11. A conduit elbow and pump assembly as claim in claim 1 wherein the elbow further includes at least one channel for receipt of cables and/or further pipework.

12. The combination conduit elbow and pump assembly of claim 1 further comprising a non-return valve between the pump inlet and pump outlet.

* * * * *